US005725278A

United States Patent [19]

Verbeek

[11] Patent Number: 5,725,278

[45] Date of Patent: Mar. 10, 1998

[54] CHAIR BACK HEIGHT ADJUSTER

[75] Inventor: Karen Christina Verbeek, Aurora, Canada

[73] Assignee: ITW Plastiglide, Concord, Canada

[21] Appl. No.: 723,650

[22] Filed: Oct. 3, 1996

[51] Int. Cl.[6] ..... B60N 2/16; B60N 2/22

[52] U.S. Cl. ..... 297/353

[58] Field of Search ..... 297/353, 411.36

[56] References Cited

U.S. PATENT DOCUMENTS

| | | | |
|---|---|---|---|
| 4,036,525 | 7/1977 | Hawk | 297/353 |
| 4,384,742 | 5/1983 | Wisniewski | 297/353 |
| 4,451,084 | 5/1984 | Seeley | 297/353 |
| 4,456,298 | 6/1984 | Gottstein | 297/353 |
| 4,616,877 | 10/1986 | Slaats et al. | 297/353 |
| 4,639,039 | 1/1987 | Donovan | 297/353 |
| 4,660,885 | 4/1987 | Sahr et al. | 297/353 |
| 4,749,230 | 6/1988 | Tornero | 297/353 |
| 5,435,626 | 7/1995 | Lai | 297/411.36 |
| 5,558,400 | 9/1996 | Poulson et al. | 297/353 X |
| 5,586,809 | 12/1996 | Szmadzinski | 297/353 |

FOREIGN PATENT DOCUMENTS

| | | | |
|---|---|---|---|
| 797012 | 10/1968 | Canada . | |
| 1053133 | 4/1979 | Canada . | |
| 1087973 | 10/1980 | Canada . | |
| 1180655 | 1/1985 | Canada . | |
| 1212614 | 10/1986 | Canada . | |
| 1232832 | 2/1988 | Canada . | |
| 1309009 | 9/1989 | Canada . | |
| 2098341 | 6/1994 | Canada . | |
| 4317609 | 12/1994 | Germany | 297/353 |

*Primary Examiner*—Peter M. Cuomo
*Assistant Examiner*—Rodney B. White
*Attorney, Agent, or Firm*—Schwartz & Weinrieb

[57] ABSTRACT

Disclosed is a device for positionally adjusting and releasably locking a chair backrest in any of a plurality of positions on a seat support member between two extreme positions. The device includes a first bracket adapted to be rigidly secured to the backrest and a second bracket adapted to be rigidly secured to the seat support member and slidably receiving the first bracket for sliding movement between two extreme, longitudinally spaced, first and second positions. A locking mechanism is provided for releasably locking the second bracket to the first bracket, the locking mechanism comprising a longitudinal array of lock stop members on the second bracket confronting a lock element secured to the first bracket, the lock stop members each having a locking surface. At least one longitudinal guide track is on the first bracket and defines a first longitudinal path and a second longitudinal path, the guide track having respective ends defining the first and second extreme positions and providing access points at such position between the paths to permit movement of the path tracking elements from one path to the other path. The lock element has a lock tongue for locking association with a locking surface of a selected one of the lock stop members. The lock element further has a path tracking element for sequential engagement with the first and second paths, wherein, when the path tracking element is in engagement with the first path, the lock element is forced into engagement with a selected one of the lock stop members and when the path tracking element is in engagement with the second path, the lock element is held out of engagement from all lock stop members.

20 Claims, 5 Drawing Sheets

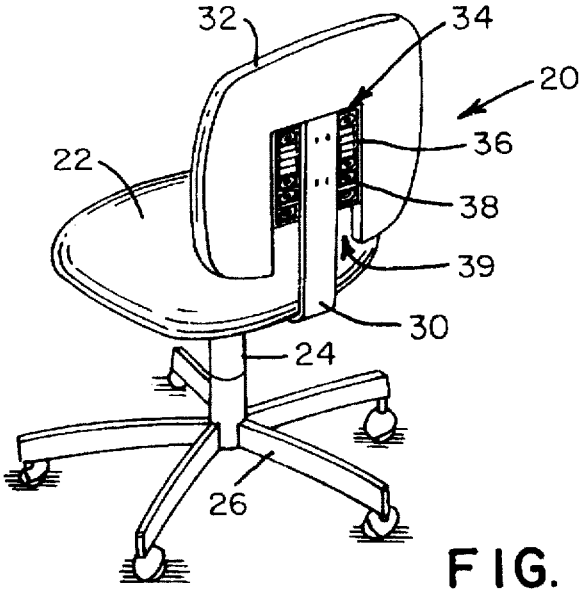
FIG. 1
FIG. 12
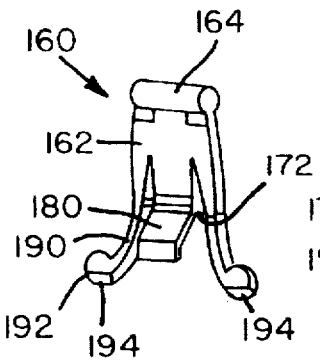
FIG. 13
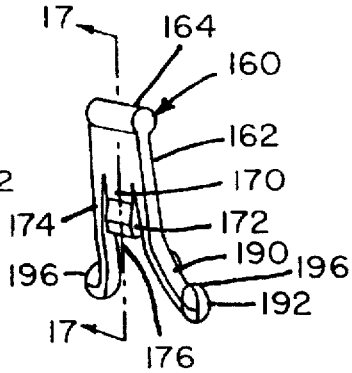
FIG. 17
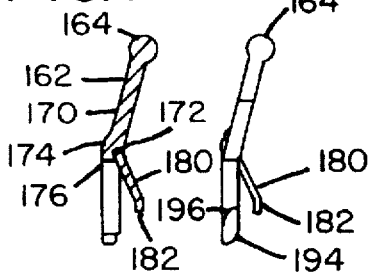
FIG. 16
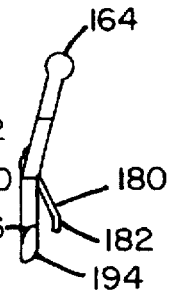
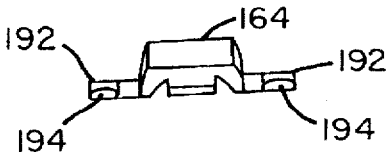
FIG. 14
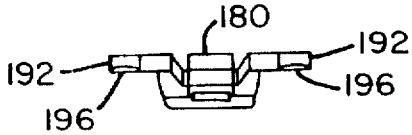
FIG. 15

CHAIR BACK HEIGHT ADJUSTER

FIELD OF THE INVENTION

The invention relates to a chair back height adjuster and more particularly to a height adjuster mechanism for chairs of all types provided with a backrest height adjustable seating system, including those of the type used in offices at executive or task work stations and the like.

BACKGROUND OF THE INVENTION

Height adjustment mechanisms for chair backrests are well known in the art. Typical of the type of mechanism is that disclosed by Donovan in U.S. Pat. No. 4,639,039 granted Jan. 27, 1987. Donovan's mechanism provides for manually positioning and releasably locking a chair backrest in a desired vertical position relative to the chair seat. Donovan uses a channel having a plurality of vertically arranged notches with cooperating spring biased latch bar and cam surface.

Another exemplary embodiment of a backrest adjustment mechanism is shown by Tornero in U.S. Pat. No. 4,749,230 granted Jun. 7, 1988. Tornero's height adjusting device comprises two guided and slideably interlocking plates and one lock pin. The device is characterized by the absence of springs or other supplementary biasing means.

Applicant believes that an adjustment mechanism which can be of molded plastic, easily produced and yet effective to permit a range of assembly techniques is warranted. An adjustment mechanism which may permit a customer to assemble the chair back to the J-bar of the chair would be advantageous. Alternatively, the manufacturer may assemble the whole structure or the manufacturer may assemble the mechanism together, assemble the mechanism to the J-bar of the chair and subsequently attach the chair back to the mechanism.

The desire to have a relatively inexpensive, yet sturdy adjustment mechanism which permits flexibility in assembly of the chairs, is significant.

SUMMARY OF THE INVENTION

The invention relates to an adjustment mechanism for backrests for chairs.

The invention provides a device for positionally adjusting and releasably locking a chair backrest in any of a plurality of positions on a seat support member between two limit positions. The device includes a first bracket adapted to be rigidly secured to the backrest and second bracket adapted to be rigidly secured to the seat support member and slidably receiving the first bracket for sliding movement between two extreme, longitudinally spaced, first and second positions. A locking mechanism is provided for releasably locking the second bracket to the first bracket, the locking mechanism comprising a longitudinal array of lock stop members on the second bracket confronting a lock element on the first bracket, the lock stop members each having a locking surface. At least one longitudinal guide track is on the second bracket and defines a first longitudinal path and a second longitudinal path, the guide track having respective ends defining the first and second limit positions and providing access points between the paths to permit movement of the path tracking element from one path to the other path. The lock element has a lock tongue for cooperative locking association with a locking surface of a selected one of the lock stop members. The lock element further has a path tracking element for sequential engagement with the first and second paths wherein, when the path tracking element is in engagement with the first path, the lock element is forced into engagement with a selected one of the lock stop members and when the path tracking element is in engagement with the second path, the lock element is held out of engagement from all lock stop members.

More particularly, the mechanism comprises a backrest bracket secured to a backrest and a J-bar bracket secured a J-bar of the chair. In addition, these parts are designed to be used in an alternative method to accommodate different chair styles.

The elements of the respective brackets are molded of plastic material, with the preferred embodiment having an integrally molded J-bar bracket and the backrest bracket assembly comprising two molded elements, the bracket itself and a lock element connected therewith. The brackets are designed to move relative to each other with the backrest bracket lock element selectively engaging one of a plurality of lock stop members on the J-bar bracket. This selective engagement of lock devices takes place as the backrest is raised with respect to the J-bar to an upper height limit whereupon further upward relative movement is prohibited unless the backrest is removed from the chair. The lock elements of the backrest bracket are disengaged automatically when the backrest reaches the upper limit and continue to be disengaged while the backrest is moved downwardly relative to the J-bar to a lower height limit, whereupon the lock mechanisms are automatically reengaged. Movement upwardly from the lower limit causes the lock elements to sequentially engage, temporarily re-engage and engage again with the lock stop members until the locking mechanism is disengaged by reaching the upper limit. Thus selected adjustment of the relative height of the backrest to the seat of the chair is permitted.

Further aspects and advantages of the invention will become evident from the following description of a preferred embodiment of the invention.

BRIEF DESCRIPTION OF THE DRAWINGS

FIG. 1 is a rear perspective view of a chair equipped with an adjustment mechanism of the invention.

FIG. 12 is a perspective view of the lock mechanism, appearing with FIG. 1 as do FIGS. 13–17.

FIG. 13 is a perspective view from the other side of the lock mechanism shown in FIG. 12.

FIG. 14 is an upper end view of the lock mechanism.

FIG. 15 is a bottom end view of the lock mechanism.

FIG. 16 is a side view of the lock mechanism as shown in FIG. 13.

FIG. 17 is a sectional view of the lock members along line 17—17 of FIG. 13.

DESCRIPTION OF PREFERRED EMBODIMENTS OF THE INVENTION

Figure 2:
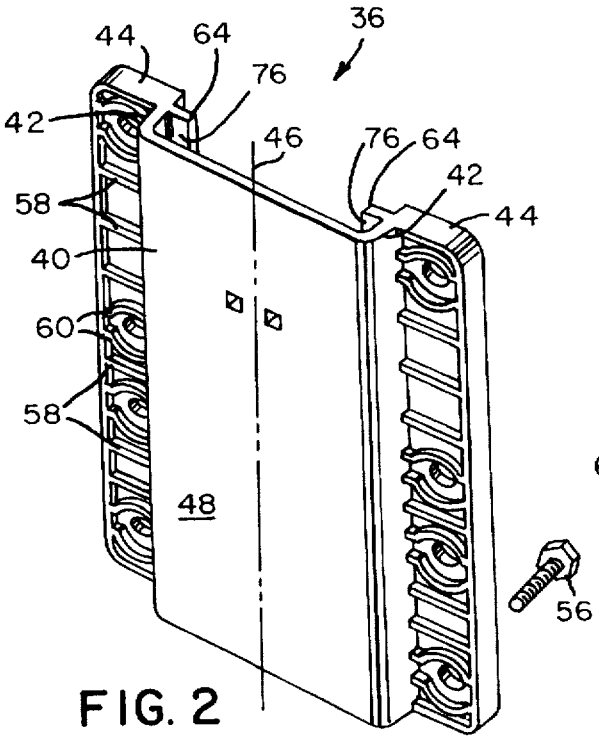
FIG. 2 is a perspective view of the backrest bracket of the adjustment mechanism as seen from the back of the chair of FIG. 1.
Figure 3:
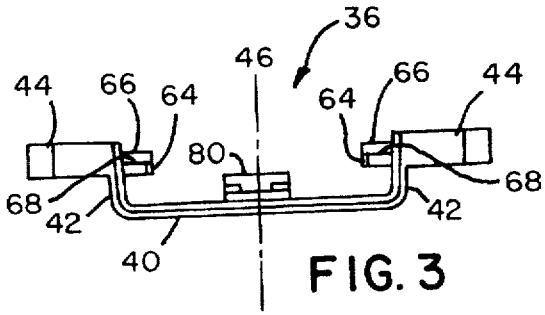
FIG. 3 is a top end view of the backrest bracket as shown in FIG. 1.

Turning to FIG. 1, a chair 20 is shown from the rear which chair 20 comprises a seat 22 supported in the usual manner on pedestal 24 and base 26. J-bar 30 is connected at one end with the seat structure or undercarriage (not shown) of seat 22 in the usual manner and extends rearwardly and upwardly in known fashion as shown in FIG. 1. J-bar 30 may be considered a support device associated with seat 22. Backrest 32 is supported by J-bar 30 through the height adjustment mechanism 34 of this invention. Height adjustment mechanism 34 comprises a backrest bracket 36 and J-bar bracket 38 in cooperative association as will become evident herein. Part of the backrest 32 is hollowed out at 39 and appropriate material (not shown) would cover the front and back of the backrest 32.

As shown in FIGS. 2–5, backrest bracket 36 of adjustment mechanism 34 is of a somewhat winged, U-shaped configuration with bight or back portion 40, sides 42 and outwardly extending flanges 44. Backrest bracket 36 is symmetrical about center line 46 and may be considered a track device.

Figure 4:
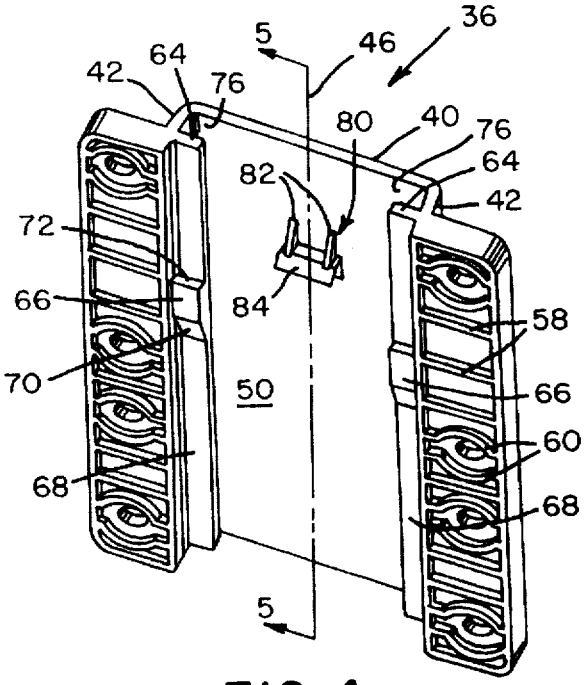
FIG. 4 is a perspective view of the backrest bracket from the opposite side to that in FIG. 2.

FIGS. 2 and 4 respectively, illustrate backrest bracket 34 in perspective from the side or face 48 of back 40 and from the opposite side or face 50. Flanges 44 each have a plurality of circular apertures 54 through which fasteners, one being shown as 56, (FIG. 2), are adapted to secure bracket 36 to back 32 of a chair. As shown in FIGS. 2 and 4, bracket 36 has a plurality of reinforcement ribs 58 and 60 on both sides of the flanges 44, the ribs 60 peripherally defining apertures 54. Ribs 58 and 60 simply provide for a lightweight, yet rigid construction of flanges 44 for use as means for securing bracket 36 to the backrest 32 of a chair.

As further shown in FIGS. 2 and 4, inwardly directed flanges 64 extend inwardly of respective sides 42 generally in line with outwardly directed flanges 44. Inwardly directed flanges 64 run substantially the length of bracket 36, with stops 66 on surfaces 68 located intermediate the ends thereof, each stop 66 being identical and having a slanted lower end or ramp 70 and upper stop or shoulder surface 72, (FIGS. 4 and 5), for purposes which shall become more evident herein. Inwardly directed flanges 44, in cooperation with face 50 of back 40 define longitudinal channels 76.

Figure 5:
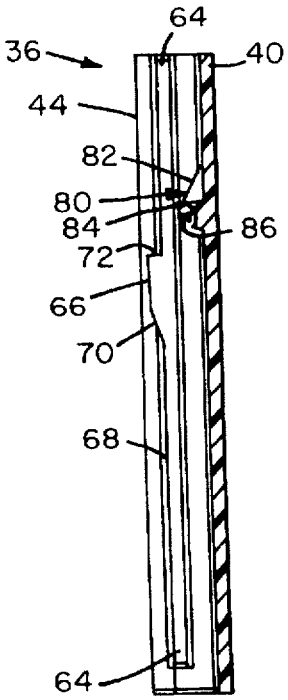
FIG. 5 is a sectional view taken along lines 5—5 of FIG. 4.

Back 40 has a lock mechanism support 80 extending from face 50, which support 80 comprises trusses 82 and a lock pivot shaft holder 84 having an arcuate recess 86 as best shown in FIGS. 4 and 5. Support 80 is preferably integrally molded with bracket 36.

Figure 6:
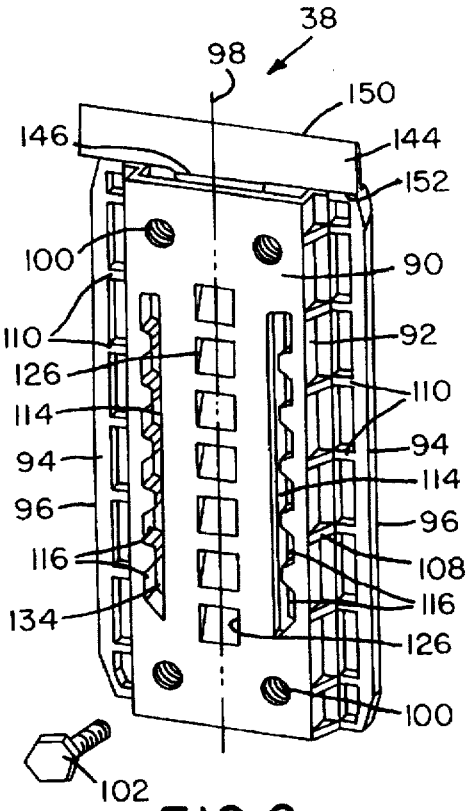
FIG. 6 is a perspective view of the J-bar bracket of the adjustment mechanism.
Figure 8:
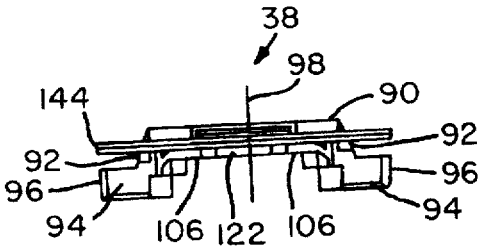
FIG. 8 is a top view of the J-bar bracket as shown in FIG. 6.
Figure 9:
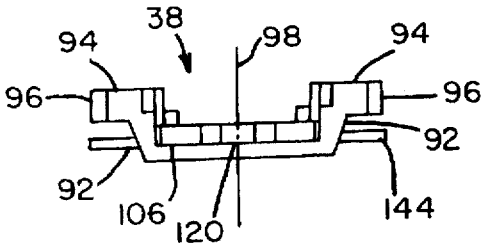
FIG. 9 is a bottom view of the J-bar bracket as shown in FIG. 7.
Figures 10, 11:
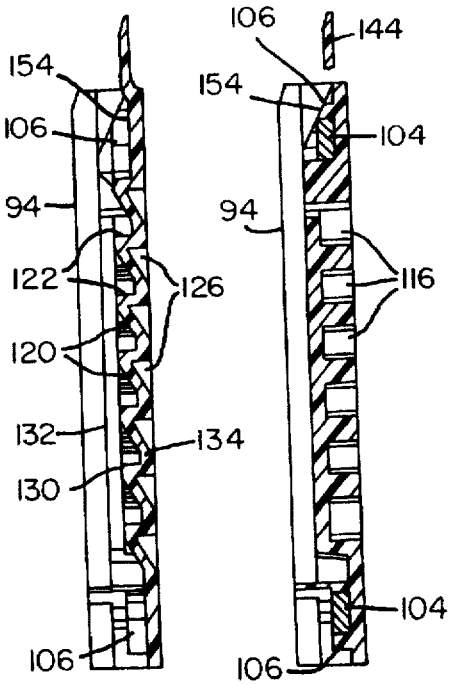
FIG. 10 is a sectional view of the J-bar bracket taken along line 10—10 of FIG. 7.
FIG. 11 is a sectional view of the J-bar bracket taken along line 11—11 of FIG. 7.
Figure 7:
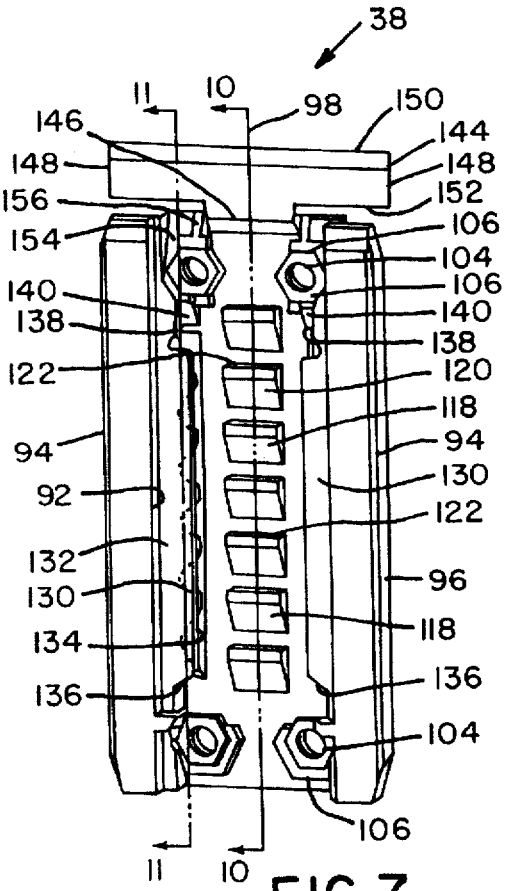
FIG. 7 is a perspective view of the J-bar bracket from the other side to that shown in FIG. 6.

Turning now to FIGS. 6–11, there is shown J-bar bracket 38 of the adjustment mechanism 34, FIGS. 6 and 7 being outside and inside perspective views, FIGS. 8 and 9 being opposite end views and FIGS. 10 and 11 being longitudinal sectional views. Bracket 38 is also generally U-shaped as seen in FIGS. 8 and 9, with back 90, sides 92 and outwardly directed flanges 94. Flanges 94 have outer edges 96 and are adapted to run in respectively associated channels 76 of backrest bracket 34. Backrest bracket 38 is symmetrical about center line 98 and may be considered a slide device slidably receivable in the backrest bracket or track device 36.

Back 90 of bracket 38 includes circular apertures 100, (four being shown), through which bracket 38 may be secured to J-bar 30 by fasteners 102, (one being shown in FIG. 6).

As seen in FIG. 7, metal nuts 104 are press-fitted into peripherally similar cavities, partly defined by ribs 106, fasteners 102 being threadedly associated with nuts 104 in securing bracket 38 to J-bar 30.

Ribs 108, (FIG. 6), on the back of sides 92 and adjacent ribs 110 on the back of flanges 94 provide for a lightweight, yet rigid structure to the bracket 38.

Back 90 of bracket 38 (FIGS. 6 and 10) also has longitudinal slots 114, each with a plurality of indentations or pockets 116 which indentations or pockets are in a longitudinal, generally sinusoidal pattern.

On the inside of back 90 there are a plurality of identical lock stop members 118, each having a front ramp surface 120 and an upper stop surface 122. There are seven stop members 118 shown in the drawings but fewer or more are possible, depending on the number of adjustments desired between selected upper and lower limit positions. Members 118 extend forwardly from the inside of back 90 and cavities 126 shown in FIGS. 6 and 10 on the outside of back 90 are simply the result of integrally molding the stop members 118 as part of bracket 38, such construction providing for a lighter structure. Flanges 130 extend laterally inwardly from sides 92 and extend longitudinally on either side of stop members 118. Flanges 130 are spaced from the inside of back 90 and cover the sinusoidal-shaped indentations 116, which indentations are symmetrical laterally and are adapted to accept laterally spaced portions of a lock mechanism to be described herein. As more particularly shown in FIG. 7, flanges 130 have a front or upper face or surface 132, a lower or back face 134, a lower flange recess or inwardly bevelled lower edge 136 and upper recess or reduced flange section 138. Ramps 140, adjacent recess 138, extend upwardly from the back 90 to the level of surface 132 of flanges 130. Ramps 140 are adjacent but spaced from recessed or reduced flange sections 138 and are aligned longitudinally with respective sinusoidal array of indentations 116. Flanges 130 are guide means defining two paths, one path being along the lower face or portion 134 where indentations or pockets 116 are and an upper or overlying path on the surface 132 of the flanges 130. Access between the paths are provided at the extreme ends of the paths and are provided by recesses 136, 138. As will become evident herein, indentations or pockets 116 provide recesses to accommodate portions of the lock mechanisms and the solid areas between pockets provides structural strength to flanges 130.

A T-shaped stop member 144 extends upwardly from the top of bracket 38 and has a flexible leg 146 and lateral wings 148. T-shaped stop member 144 has a bevelled upper edge 150, a lower straight edge 152 and a width such that it will freely move between the sides 42 of backrest bracket 36 and on surfaces 68 of flanges 64 thereof (FIG. 4). T-shaped stop member 144, including leg 146, is sufficiently flexible that wings 148 will flex over respective stops 66 as a result of bevelled edge 150 running over ramps 70. T-shaped member 144 snaps back so that lower edge 152 thereof, in cooperation with stop surfaces 72, prevents unintended separation of the two brackets 36, 38 once they are assembled in operative association. The brackets can be separated by using a tool to deflect T-shaped stop members out of engagement with stops 66. As shown in FIGS. 7, 10 and 11, the upper end of bracket 38 has ramps 154 and 156, (the latter part of ribs 106), the ramps leading to and guiding portions of the lock mechanism 160 (to be described) onto surfaces 132 of flanges or guide track 130 when the brackets are first assembled, as will become more evident from the description herein.

Turning to FIGS. 12 to 15, the lock mechanism 160 is shown, FIGS. 12 and 13 being perspective views thereof. Lock mechanism 160 includes body portion 162 with pivot shaft 164 integrally molded as part of the upper end thereof. Lock tongue 170 extends from body portion 162 and has outer end 172 with ramp 174 and lock stop surface 176. Leaf spring 180 extends from outer end 172 of lock tongue 170 and has a slightly curved outer end 182. Flexible or spring legs 190, being mirror images of each other, extend from body portion 162 on either side of lock tongue 170, legs 190 curving outwardly slightly and having bulbous ends 192. Bulbous ends 192 are generally circular with bevelled portions 194 and 196, as best shown in FIG. 16. Spring legs 190 are flexible laterally inwardly and outwardly but are biased naturally outwardly a width at least the width between sides 92. The contour and configuration of the bulbous ends 192 is such as to permit ends 192 to ride over respective surfaces 132 of flanges 130 as well as in and over the sinusoidal array of indentations or pockets 116 and contained therein by the bottom face 134 of flanges 130. Bulbous ends 192 are also adapted to ride up ramps 140 adjacent reduced sections 138 of flanges 130 and to spring outwardly slightly to ride on surfaces 132 of flanges 130. Bulbous ends 192 are also adapted to snap back into alignment with sinusoidal indentations 116 through the gap provided by bevelled lower ends 136 of flanges 130. Ends 192 provide means adapted to track the respective paths defined by flange 130, as noted previously. Ends 192 are naturally forced outwardly by legs 190 and ride in the indentations or pockets 116 with a clicking sound to provide also a positive sound to engagement of the lock tongue with lock stop means. A feeling of positive tension to movement is also provided. The legs also provide lateral stability to the lock mechanism. Although a sinusoidal array of indentations are preferred as they add support to the longitudinal flange 130, they are not primarily intended to provide any locking feature. Nevertheless they do add a positive stability feature to the lock mechanism.

Figure 18:
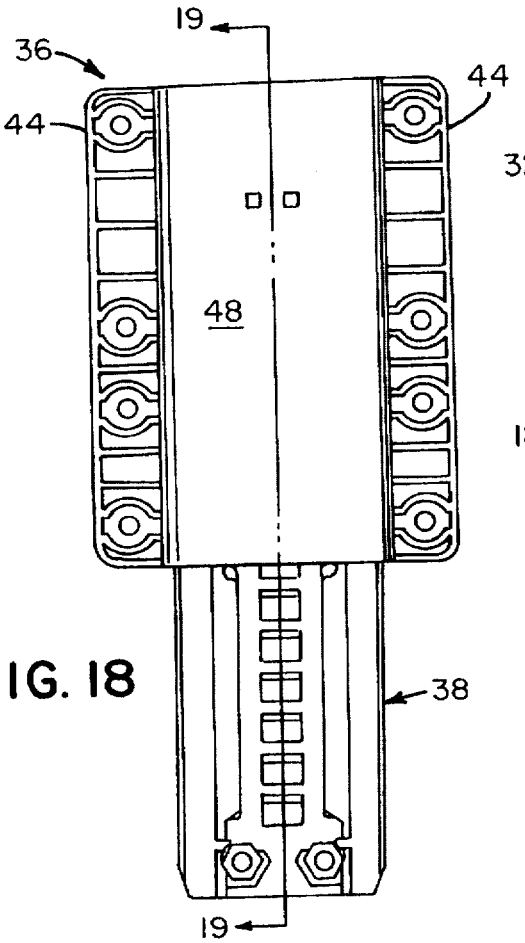
FIG. 18 is a view of the adjustment mechanism as it is being assembled.
Figure 19:
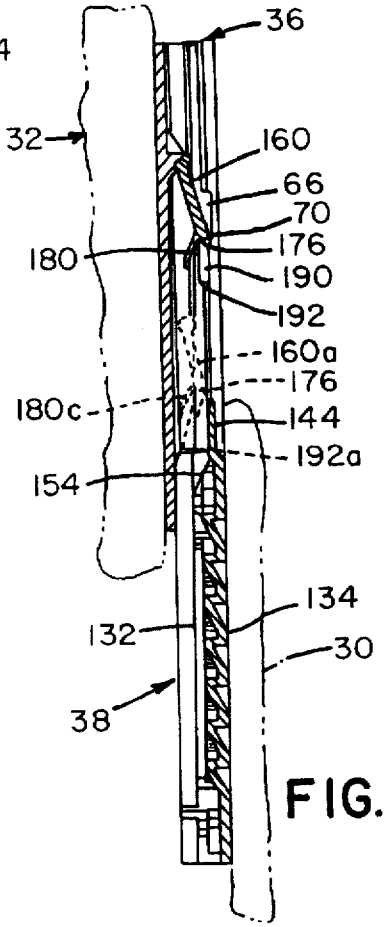
FIG. 19 is a sectional view of the mechanism as shown in FIG. 18 as taken along lines 19—19 thereof but with the backrest and J-bar shown in phantom lines.
Figure 22:
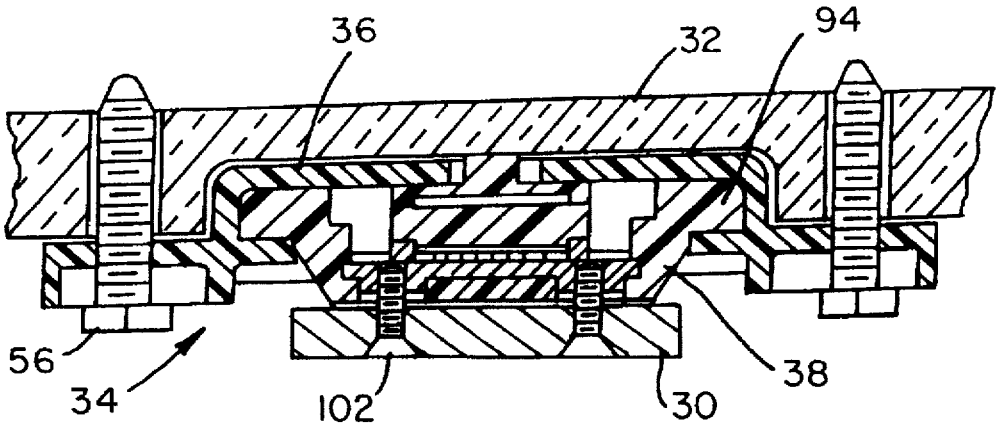
FIG. 22 is a sectional view of part of the backrest shown in FIG. 1 taken along line 22—22 thereof.

In assembling the adjustment mechanism comprising the three pieces, namely the backrest bracket 36, J-bar bracket 38 and lock mechanism 160, each one of which is separately molded, lock mechanism 160 is secured to support 80 by pressing lock shaft 164 into arcuate recess 86 of shaft holder 84. Turning to FIGS. 18 and 19, J-bar bracket 38 is then assembled with backrest bracket whereby the J-bar bracket flanges 94 slide within channels 76 of backrest bracket 36. FIG. 22 shows a sectional view of the assembly of brackets 36 and 38. Looking at FIG. 19, as bracket 38 is moved upwardly relative to bracket 38, T-shaped stop member 144 contacts ramps 70 of stops 66 and flexes such that T-shaped stop member 144 moves over stops 66, snaps back so that separation of the two brackets without intentionally flexing T-shaped stop member 144 out of engagement with stops 66 is prevented.

During further assembly of brackets 36, 38, spring leg bulbous ends 192 of lock member 160 move up ramps 154, 156 and onto flange surfaces 132, the outward bias of the spring legs 190 keeping the ends 192 from entering flange reduced sections 138. Forcing the bulbous ends onto flanges 130 flexes leaf spring 180 (see dotted line 180*a* in FIG. 19) against back surface 50 to place the lock member under a bias to the right in FIG. 19. Further relative movement between the brackets 36, 38 cause bulbous ends 192 to ride on along and follow the path of surfaces 132 of flanges 130 (see dotted lines 192*a* and 192*b* in FIG. 20) until the bulbous ends 192 reach flange indentations 138 whereupon the bias effected by leaf spring 180 causes the bulbous ends to be forced to the right in FIGS. 19 and 21 and enter in alignment with respective sinusoidal indentations 116 (see dotted lines 192*d* in FIGS. 20, 21 and be contained therein by lower flange surface 134). The backrest bracket 36 is then in full assembly with bracket 38. With J-bar bracket 38 attached to J-bar 30, the backrest adjustment mechanism is operative to permit selected height adjustment of the backrest.

Figure 20:
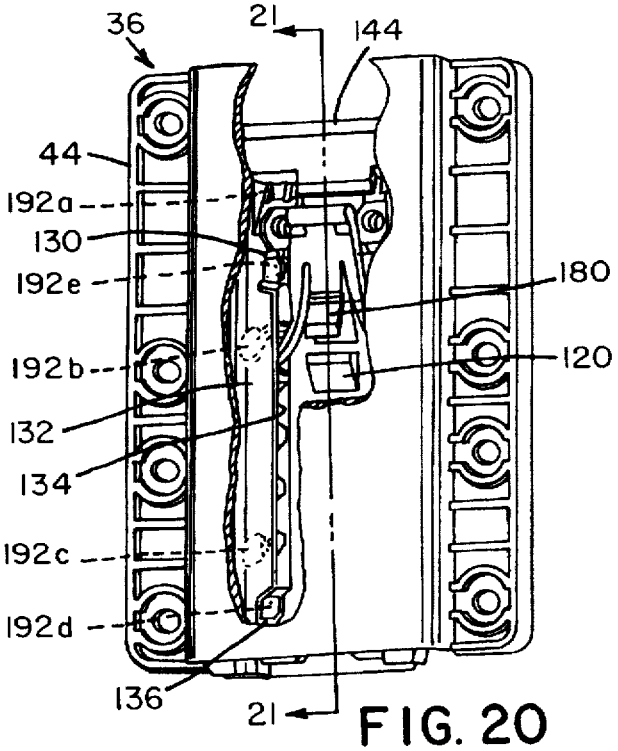
FIG. 20 is a perspective view of the adjustment mechanism with part of the back of the backrest bracket broken away.
Figure 21:
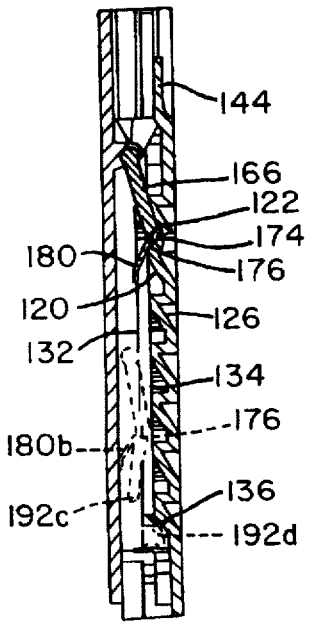
FIG. 21 is a sectional view of the mechanism as shown in FIG. 20 taken along line 21—21 thereof.

Pulling up on backrest 32 causes backrest (slide) bracket 36 to move or slide upward relative to J-bar (track) bracket 38 as seen in FIGS. 20 and 21. Ramp 174 of lock tongue 170 contacts and rides over the various ramps 120 of stop members 118 with lock tongue stop surface 176 being flexed in and out of engagement with various stop surfaces 122 of stop members 118 until a desired height of the backrest is achieved. Simultaneously, bulbous ends 192 moves in and out of the respective indentations or pockets 116, which indentations are located such that when lock tongue stop surface 176 is in contact with a stop surface 122, bulbous ends 192 are within associated indentations 116, providing stability to the lock mechanism.

If a higher height of the backrest 32 relative the J-bar 30 is desired, then simply pulling up on the backrest 32 causes bracket 36 to move upwardly with the lock tongue stop surface 176 being caused to disengage stop member surface 122 due to contact between lock tongue ramp 174 and ramp 120 of the next higher stop member 118. Leaf spring 180 assists in forcing the stop surfaces 174 and 122 into engagement by contacting face 50 of bracket backrest back 40.

If a lower height of the backrest 32 is desired relative to the seat 22, the backrest 32 is pulled as high as the adjustment mechanism permits, i.e. to a high limit position relative to J-bar 30, whereupon the spring legs bulbous ends 192 are cammed out of alignment with indentations 116 and confinement by flange surface 134 by ramps 140 at flange reduced or recessed sections 138. Once through recessed sections 138, the legs 190 spring laterally and onto the upper respective surfaces 132 of flanges 130. This causes separation of lock tongue stop surface 176 from the stop surface 122 of stop members 118. The movement (downwardly) of the backrest causes movement of bracket 36 and lock mechanism 160 and bulbous ends 192 move along surfaces 132 causing the stop surfaces 176 and 122 to remain disengaged and permit relative movement of the brackets 36, 38 to lower the backrest to its lowest limit position relative the seat. As shown in phantom lines in FIG. 20, bulbous end 192, being cammed up ramp 140, move from position **192*e* to 192*b* on surface 132 of flanges 130. Repeating the process of entering lower end bevelled indentations 138 of flange 130 and return into alignment at 192*d* with the line of sinusoidal indentations 116. The backrest 32 is then ready to be pulled upwardly until the desired height is achieved by locking surface 174 of lock tongue 170 and a lock stop surface 122 of a selected lock stop member 118**.

FIG. 22 is a cross-sectional view of the assembly illustrated in FIG. 1.

Figure 23:
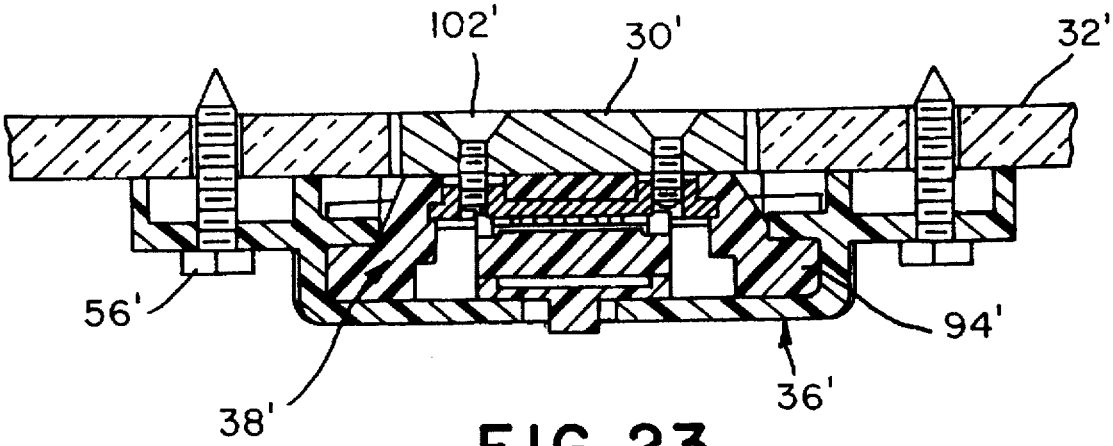
FIG. 23 is a sectional view of part of the backrest similar to FIG. 1 but illustrating an alternative assembly configuration of the bracket and backrest and J-bar support to that shown in FIG. 22.

FIG. 23 illustrates a similar cross-sectional view to that of FIG. 22 but with the chair backrest 32' and J-bar 30' in an alternative assembly with backrest bracket 36' and J-bar bracket 38'. It should be noted that the J-bar 30' and backrest 32' need not be flush or planar as shown in the alternative.

Brackets 36, 36', 38, 38' and lock mechanism 160 are each integrally molded of plastic material which is rugged, yet lightweight and susceptible to long lasting, repetitive operation without failure. In a preferred embodiment, backrest bracket 36 and lock mechanism 160 are of an acetal plastic with J-bar bracket 38 of a glass reinforced nylon. The slots 114 and sinusoidal indentations or pockets 116 in the back 90 permit easy molding of the sinusoidal surfaces 116 notwithstanding flanges 130 are also molded integral with the walls 92.

Accordingly, the height adjustment mechanism is self contained, enabling the height of the backrest to be selected, by pulling upon the backrest. If a lower height is desired, the backrest is pulled up to the full height whereupon the stop members are automatically forced apart and the backrest can be returned to its lowest position for movement upwardly to the desired height. Thus the sequence is cyclical but easy to operate since the sequence is essentially automatic by simply lifting the backrest and backrest bracket upwardly, then pushing it downwardly to its lowest extent and then moving it upwardly to select the desired relative height location.

I claim:

1. A device for positionally adjusting and releasably locking a chair backrest in any of a plurality of positions on a seat support member comprising:

a first bracket means adapted to be rigidly secured to said backrest;

second bracket means adapted to be rigidly secured to said seat support member and slidably received in said first bracket means for sliding movement between two extreme, longitudinally spaced, first and second positions; and locking means for releasably locking said second bracket means to said first bracket means, comprising:

a longitudinal array of lock stop members on said second bracket confronting a lock element on said first bracket, said lock stop members each having a locking surface and said lock element having lock tongue means for cooperative locking association with said locking surfaces of said lock stop members, said lock element further having path tracking means;

longitudinal guide means on said second bracket and defining a first longitudinal path and a second longitudinal path, said guide means having respective ends defining said first and second extreme positions and providing access means between said paths;

said lock element tracking means adapted to engage and cooperate with said first and second paths, wherein, when said path tracking means is in engagement with said first path, said lock element is forced into engagement with a selected one of said lock stop members and when said path tracking means is in engagement with said second path, said lock element is held out of engagement from all lock stop members and means adjacent said respective access means to permit movement of said path tracking means from one path to the other path.

2. The adjustment device according to claim 1 wherein said first path includes a sinusoidal array of indentations for cooperative association with said path tracking means.

3. The adjustment device of claim 2 wherein said path tracking means comprises flexible leg means having a bulbous end adapted to cooperate with said array of indentations.

4. The adjustment device according to claim 1 wherein said lock element further comprises spring bias means which positively biases said lock element into engagement with said respective lock stop members.

5. The adjustment device according to claim 4 wherein said spring bias means also biases said path tracking means from said second path to said first path through said second access means.

6. The adjustment device of claim 5 wherein said first access means between said paths comprises recess means in said guide means and ramp means adjacent said recess means to force said path tracking means from said first path to said second path at said first extreme position.

7. The adjustment device of claim 6 wherein said second access means between said paths is defined by a recess in said guide means of said second extreme position and said path tracking means is connected to said lock element and said lock element includes means to bias said path tracking means through said second access means.

8. The adjustment device according to claim 1 wherein said first bracket comprises an integrally molded support for said lock element and said lock element is molded separately for connection to said support.

9. The adjustment device according to claim 1 wherein said seat support member of said chair is an upper portion of a J-bar of the chair and said device provides for adjustment of the height of said backrest relative to a seat portion of the chair.

10. An adjustment mechanism for controlling relative movement between a chair back and a second member of a chair between first and second extreme positions, comprising:

a first, generally U-shaped, bracket and a second generally U-shaped, bracket;

said first bracket having means for securing said first bracket to said chair back and comprising a back support surface, laterally spaced, longitudinally extending, channel means and a lock mechanism, said lock mechanism extending forward of said back support surface between said laterally spaced channel means;

said second bracket having means for securing said second bracket to said second member of said chair and comprising a back surface and laterally spaced, longitudinally extending sides, said sides having outer edges adapted to slide within respective ones of said first bracket channel means;

said second bracket having longitudinally extending flange means extending inwardly from each side, each said flange means having a lower face and an upper face, the lower face of each said flange means and an adjacent portion of said side of said second bracket defining a first path and the upper surface of each said flange means and adjacent portions of said side defining a second path, lock stop members extending forwardly of said second bracket back support and between said flange means and longitudinally spaced first and second access means at said first and second extreme positions respectively providing access between said first path and said second path;

said lock mechanism comprising a lock element for cooperative association with selected ones of said lock stop members and comprising flexible leg means having outer ends for sequential cooperative association with said first and second paths;

whereby, when said brackets are in operative association, the outer side edges of said second bracket are within respective channel means of said first bracket and said lock element is in confronting relation with said array of lock stop members, said leg means being adapted to move alternately along and between said first path and said second path through said spaced first and second access means, said flexible leg means constraining said lock element in a latch position with respect to one of said lock stop members when said leg ends move along said first path in a first longitudinal direction from said second extreme position to said first extreme position and for maintaining disengagement of said lock element from any of said stop members when said leg ends move along said second path in a second longitudinal direction from said first extreme position to said second extreme position.

11. The adjustment mechanism according to claim 10 wherein the first path includes a sinusoidal array of indentations for cooperative association with the ends of said flexible leg means.

12. The adjustment mechanism of claim 11 wherein said ends of said flexible leg means are bulbous elements adapted to cooperate with said array of indentations.

13. The adjustment mechanism according to claim 10 wherein said lock element includes spring bias means which acts in cooperation with the back of said first bracket to bias said lock element into engagement with said lock stop members.

14. The adjustment mechanism according to claim 13 wherein said spring bias means also biases said flexible leg ends from said second path to said first path through said second access means.

15. The adjustment mechanism of claim 14 wherein said first access means between said paths comprises ramp means and adjacent recesses in said flange means to force and permit passage of said respective flexible leg ends from said first path to said second path at said first position.

16. The adjustment mechanism according to claim 10 wherein said second access means between said paths is defined by a recess in said flange means at said second extreme position and said flexible leg means are connected to said lock element and said lock element includes spring bias means to bias the ends of said leg means from said second path to said first path in said second extreme position.

17. The adjustment mechanism of claim 10 wherein said first bracket comprises an integrally molded support for said lock mechanism and said lock mechanism is molded separately for connection to said support.

18. The adjustment mechanism according to claim 10 wherein said second member of said chair is an upper portion of a J-bar of the chair and said adjustment mechanism provides for adjustment of the height of said backrest relative to a seat portion of the chair.

19. The adjustment mechanism according to claim 10 wherein said channel means of said first bracket has stop means and said second bracket has a stop member for operative association with said first bracket stop means to prevent unintentional disassembly of said brackets once assembled.

20. The adjustment mechanism according to claim 10 wherein said lock stop members each comprise a ramp surface and lock surface and said lock element includes a ramp surface and lock surface, whereby when said brackets are moved relative to each other in said first direction, said lock element ramp cooperates with said stop member ramp surface to move said stop element lock surface out of a locking engagement position with a lock surface of a lock stop member.

* * * * *